US012129855B2

(12) United States Patent
Nishimori et al.

(10) Patent No.: US 12,129,855 B2
(45) Date of Patent: Oct. 29, 2024

(54) SOUND ABSORBING COVER AND VIBRATION INSULATING SUPPORT FOR AN ELECTRIC COMPRESSOR

(71) Applicant: KABUSHIKI KAISHA TOYOTA JIDOSHOKKI, Kariya (JP)

(72) Inventors: Noritaka Nishimori, Aichi-ken (JP); Toshiyuki Kobayashi, Aichi-ken (JP); Suehiro Fukazawa, Aichi-ken (JP); Toshiyuki Miyano, Aichi-ken (JP); Takayuki Kato, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 17/698,773

(22) Filed: Mar. 18, 2022

(65) Prior Publication Data

US 2022/0307506 A1 Sep. 29, 2022

(30) Foreign Application Priority Data

Mar. 23, 2021 (JP) ..... 2021-048972

(51) Int. Cl.
*F04C 29/06* (2006.01)

(52) U.S. Cl.
CPC ..... *F04C 29/063* (2013.01); *F04C 29/066* (2013.01); *F04C 2240/30* (2013.01); *F04C 2270/12* (2013.01)

(58) Field of Classification Search
CPC .. F04C 29/063; F04C 29/066; F04C 2240/30; F04C 2270/12; F04C 29/065;
(Continued)

(56) References Cited

U.S. PATENT DOCUMENTS 5,137,432 A * 8/1992 Tsai ..... F04B 39/0033 181/240
9,267,565 B2 * 2/2016 Tomiyama ..... F16F 15/08
11,084,355 B2 * 8/2021 Shin ..... B60H 1/32

FOREIGN PATENT DOCUMENTS

CN 106907325 * 3/2017 ..... F04C 29/063
CN 107387417 A 11/2017
(Continued)

OTHER PUBLICATIONS

English translation of JP2013194673 generated from Espacenet Feb. 25, 2022 (Year: 2022).*
(Continued)

*Primary Examiner* — Bryan M Lettman
(74) *Attorney, Agent, or Firm* — Sughrue Mion, PLLC

(57) ABSTRACT

An electric compressor includes a compression portion, an electric motor, an inverter, a housing, a support bracket, a vibration insulator, and a soundproofing cover. The compression portion is configured to compress a fluid. The electric motor is configured to drive the compression portion. The inverter is configured to drive the electric motor. The housing includes an outer peripheral surface that has a cylindrical shape and accommodates the compression portion, the electric motor, and the inverter. The support bracket is fastened to the housing and supports the housing to an object to which the electric compressor is mounted. The vibration insulator is interposed between the support bracket and the object. The soundproofing cover is made of an elastically deformable sound absorbing material and covers the housing and the support bracket.

5 Claims, 4 Drawing Sheets

(58) Field of Classification Search
CPC .... F04B 53/002; F04B 53/003; F04B 53/001; F04B 39/0033; F04B 39/0044; B65D 25/24; B65D 61/00; B65D 2581/02
USPC ..... 417/363
See application file for complete search history.

(56) References Cited

FOREIGN PATENT DOCUMENTS

| | | | | |
|---|---|---|---|---|
| EP | 3690330 | A1 | | 8/2020 |
| JP | 05-014572 | U | | 2/1993 |
| JP | 2013-194673 | A | | 9/2013 |
| JP | 2013194673 | | * | 9/2013 |
| JP | 2015-090130 | A | | 5/2015 |
| JP | 2017-044313 | A | | 3/2017 |
| JP | 2020-133408 | A | | 8/2020 |
| KR | 20020044428 | A | | 6/2002 |

OTHER PUBLICATIONS

English translation of CN106907325 generated from Espacenet Jun. 29, 2023 (Year: 2023).*

* cited by examiner

SOUND ABSORBING COVER AND VIBRATION INSULATING SUPPORT FOR AN ELECTRIC COMPRESSOR

CROSS-REFERENCE TO RELATED APPLICATION

This application claims priority to Japanese Patent Application No. 2021-048972 filed on Mar. 23, 2021, the entire disclosure of which is incorporated herein by reference.

BACKGROUND ART

The present disclosure relates to an electric compressor.

An electric compressor includes a compression portion configured to compress a fluid, an electric motor configured to drive the compression portion, and an inverter configured to drive the electric motor. In such an electric compressor, a noise is generated by driving the compression portion or by driving the electric motor. The noise generated by driving the compression portion or by driving the electric motor causes a housing of the electric compressor to vibrate, resulting in generating a radiated sound.

An electric compressor disclosed in Japanese Patent Application Publication No. 2013-194673, for example, includes a soundproofing cover covering an entire circumference of an outer peripheral surface of a housing of the electric compressor. Even when a noise generated by driving a compression portion or by driving an electric motor causes the housing of the electric compressor to vibrate to generate a radiated sound, the radiated sound is absorbed by the soundproofing cover, and thus the noise from the electric compressor is reduced.

An electric compressor for a vehicle is mounted on an object to be mounted, such as a frame and an engine of the vehicle, for example. Specifically, as in an electric compressor disclosed in Japanese Patent Application Publication No. 2017-44313, for example, a support bracket supports a housing of the electric compressor to the object. A vibration insulator is interposed between the support bracket and the object to thereby reduce transmission of a vibration generated from the housing to the object via the support bracket.

However, if the vibration generated from the housing is transmitted to the support bracket, the support bracket may vibrate, which may result in generating a radiated sound from the support bracket. The radiated sound generated from the support bracket may cause a noise from the electric compressor.

The present disclosure is directed to providing an electric compressor capable of reducing a noise generated therefrom.

SUMMARY

In accordance with an aspect of the present disclosure, an electric compressor includes a compression portion, an electric motor, an inverter, a housing, a support bracket, a vibration insulator, and a soundproofing cover. The compression portion is configured to compress a fluid. The electric motor is configured to drive the compression portion. The inverter is configured to drive the electric motor. The housing includes an outer peripheral surface that has a cylindrical shape and accommodates the compression portion, the electric motor, and the inverter. The support bracket is fastened to the housing and supports the housing to an object to which the electric compressor is mounted. The vibration insulator is interposed between the support bracket and the object. The soundproofing cover is made of an elastically deformable sound absorbing material and covers the housing and the support bracket.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

Figure 1:
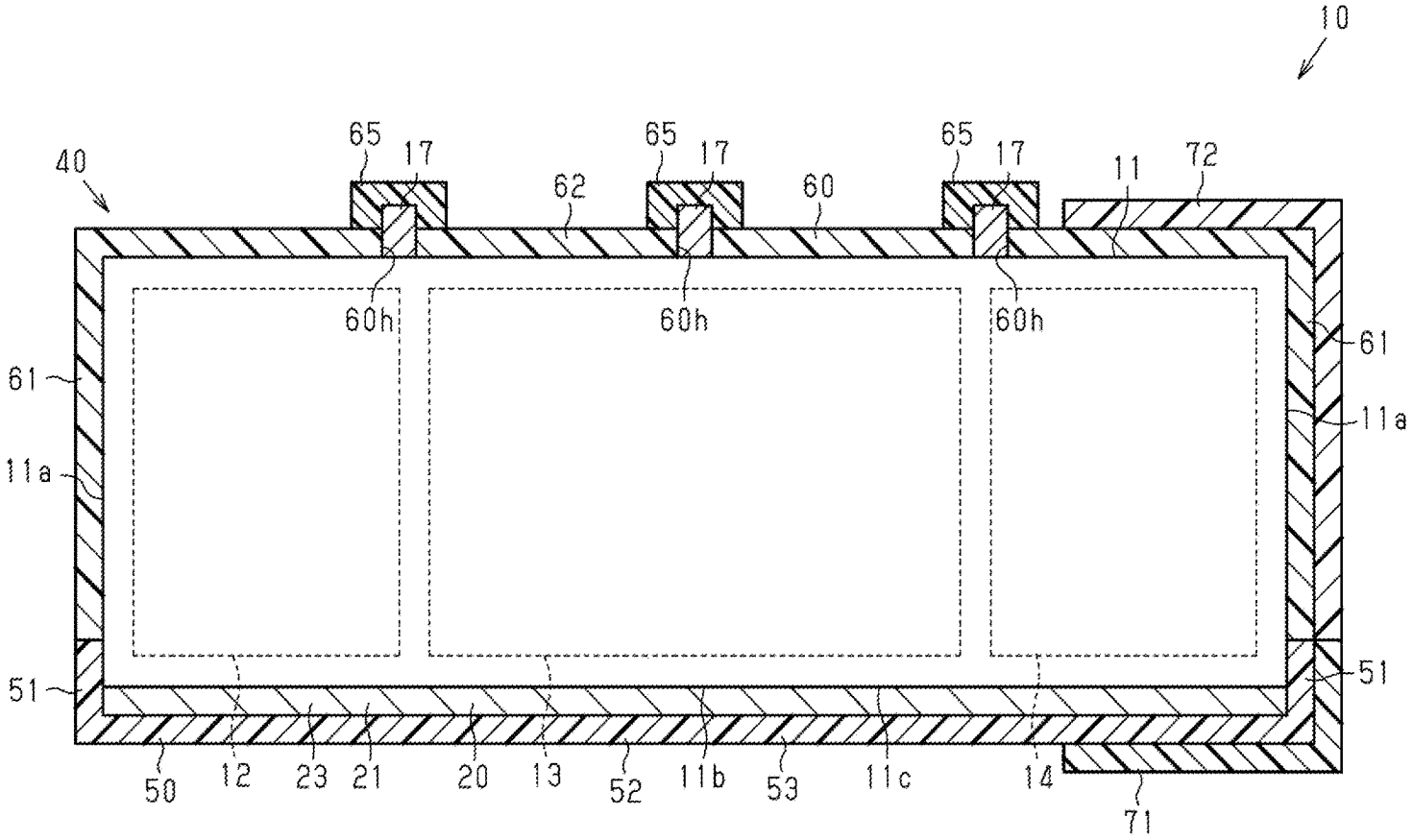
FIG. 1 is a schematic longitudinal sectional view of an electric compressor according to an embodiment of the present disclosure.
Figure 2:
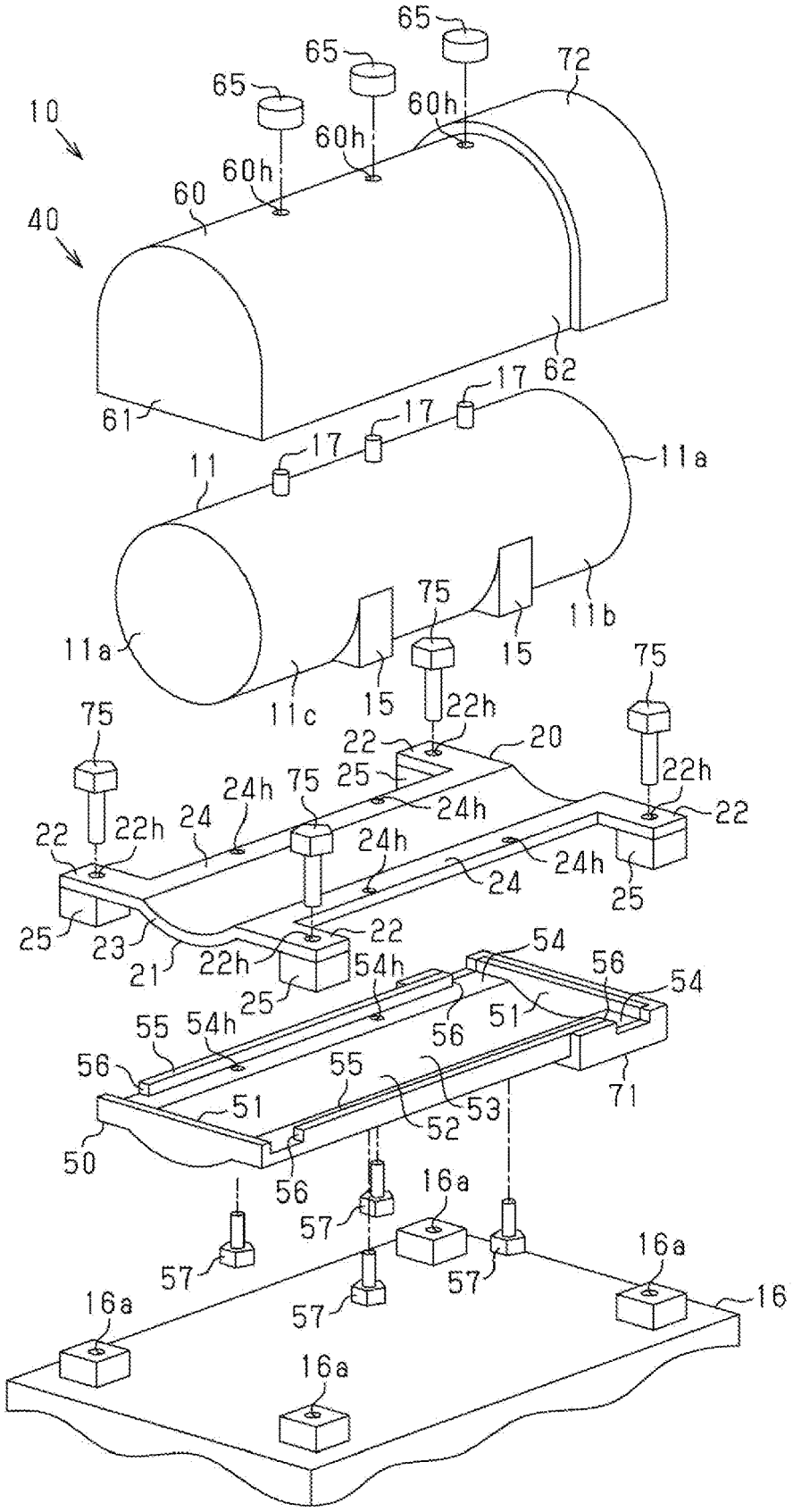
FIG. 2 is an exploded perspective view of the electric compressor according to the embodiment.
Figure 3:
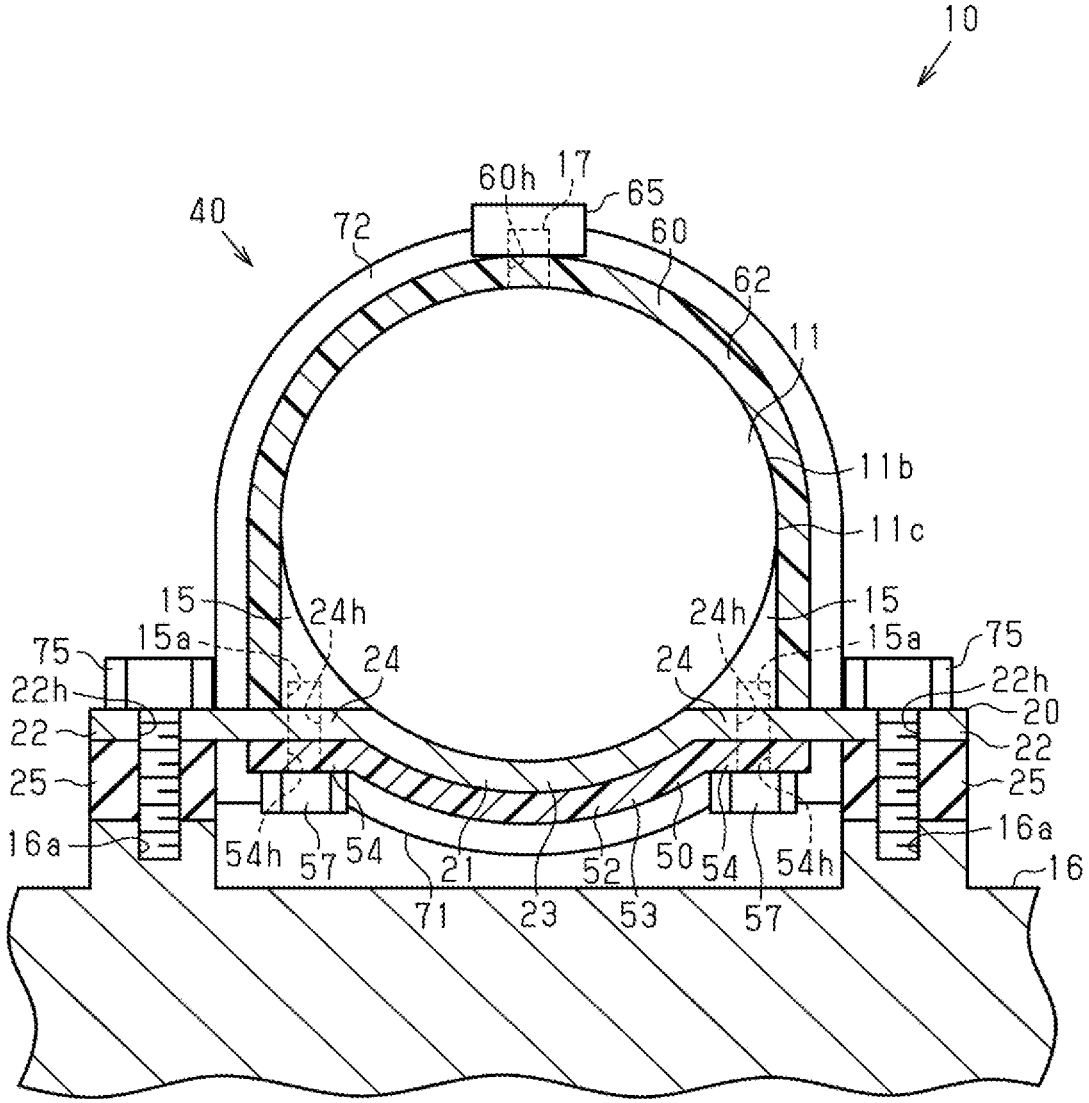
FIG. 3 is a schematic cross-sectional view of the electric compressor according to the embodiment.

The following will describe an electric compressor according to an embodiment of the present disclosure with reference to FIGS. 1 to 3. The electric compressor according to the embodiment is mounted to a vehicle body to which the electric compressor is to be mounted, for example, and used for an air conditioning system for the vehicle.

Overall Configuration of Electric Compressor 10

As illustrated in FIGS. 1 and 2, an electric compressor 10 includes a housing 11. The housing 11 has a cylindrical shape. The housing 11 is made of a metal material, for example, aluminum. The housing 11 includes a pair of end walls 11*a* each having a plate shape, and a peripheral wall 11*b* having a cylindrical shape. The peripheral wall 11*b* connects the pair of end walls 11*a* to each other. In other words, the housing 11 has an outer peripheral surface 11*c* of the peripheral wall 11*b* having the cylindrical shape.

As illustrated in FIG. 1, the electric compressor 10 includes a compression portion 12 configured to compress a refrigerant as a fluid, an electric motor 13 configured to drive the compression portion 12, and an inverter 14 configured to drive the electric motor 13. The housing 11 accommodates the compression portion 12, the electric motor 13, and the inverter 14. The compression portion 12, the electric motor 13, and the inverter 14 are disposed side by side in an axial direction of the housing 11 in this order.

The compression portion 12 may be provided by, for example, a scroll type that includes a fixed scroll fixed to an inner peripheral surface of the peripheral wall 11*b* of the housing 11 and a movable scroll facing the fixed scroll. The electric motor 13 is driven by power supplied from the inverter 14. The compression portion 12 that is driven by the driven electric motor 13 compresses the refrigerant taken into the housing 11.

Configuration of Mounting Leg 15

As illustrated in FIGS. 2 and 3, the electric compressor 10 includes a plurality of mounting legs 15. The electric compressor 10 of the present embodiment includes four mounting legs 15. The four mounting legs 15 are disposed on the outer peripheral surface 11*c* of the peripheral wall 11*b* of the housing 11. Two of the four mounting legs 15 are disposed on one of both sides of the outer peripheral surface 11*c* of the peripheral wall 11*b* of the housing 11 with respect to an axial line of the housing 11. The other two of the four mounting legs 15 are disposed on the other of the both sides of the outer peripheral surface 11*c* of the peripheral wall 11*b* of the housing 11 with respect to the axial line of the housing 11. The mounting legs 15 each have a female screw hole 15*a*. The axial line of the female screw hole 15*a* extends in a direction orthogonal to the axial direction of the housing 11. The electric compressor 10 of the present embodiment is disposed so that an opening of the female screw hole 15*a* of each of the mounting legs 15 faces a vehicle body 16, i.e., the object to which the electric compressor 10 is to be mounted.

Configuration of Shank Portion 17

The electric compressor 10 includes a plurality of shank portions 17. The plurality of shank portions 17 is protruded from the outer peripheral surface 11*c* of the peripheral wall 11*b* of the housing 11. Each of the shank portions 17 is integrally formed with the housing 11. In other words, the housing 11 includes the shank portions 17. Each of the shank portions 17 has a cylindrical shape. The shank portions 17 each protrude from the outer peripheral surface 11*c* of the peripheral wall 11*b* of the housing 11 on a side opposite to the mounting legs 15 with respect to the axial line of the housing 11. The shank portions 17 protrude from the outer peripheral surface 11*c* of the peripheral wall 11*b* of the housing 11 in a direction perpendicular to the axial direction of the housing 11 and opposite to the openings of the female screw holes 15*a* of the mounting legs 15. In other words, in a state where the electric compressor 10 is mounted on the vehicle body 16, the shank portions 17 protrude from the outer peripheral surface 11*c* of the peripheral wall 11*b* of the housing 11 toward a side opposite to the vehicle body 16. The shank portions 17 are disposed side by side at intervals in the axial direction of the housing 11.

Configuration of Support Bracket 20

The electric compressor 10 includes a support bracket 20. The support bracket 20 is fastened to the housing 11. The support bracket 20 supports the housing 11 with respect to the vehicle body 16, i.e., the object to which the electric compressor 10 is to be mounted. In other words, the support bracket 20 is interposed between the housing 11 and the vehicle body 16. The support bracket 20 is made of metal, for example. The support bracket 20 is formed by press-molding a single metal plate having a rectangular flat plate shape.

The support bracket 20 includes a bracket body 21, and four mounting portions 22 to be fixed to the vehicle body 16. The bracket body 21 includes a body 23 and a pair of extensions 24. The body 23 having a plate shape extends in the axial direction of the housing 11 and curves along the outer peripheral surface 11*c* of the peripheral wall 11*b* of the housing 11. A longitudinal direction of the body 23 coincides with the axial direction of the housing 11. The extensions 24 each having a flat plate shape extend outwardly from respective side edges of the body 23 in a circumferential direction. A longitudinal length of each of the pair of extensions 24 is identical with a longitudinal length of the body 23.

The extensions 24 each have two through holes 24*h*. Each of the through holes 24*h* extends through the associated extension 24 in a thickness direction. The support bracket 20 is disposed so that the through holes 24*h* communicate with the female screw holes 15*a* of the associated mounting legs 15 of the housing 11.

Two of the four mounting portions 22 protrude from both ends of one of the pair of extensions 24 in the longitudinal direction toward one side opposite to the body 23. The other two of the four mounting portions 22 protrude from both ends of the other of the pair of extensions 24 in the longitudinal direction toward the other side opposite to the body 23. The mounting portions 22 each have a flat plate shape. The mounting portions 22 each have an insertion hole 22*h*. Each of the insertion holes 22*h* extends through the associated mounting portion 22 in a thickness direction.

Vibration Insulator 25

The electric compressor 10 includes vibration insulators 25. The vibration insulators 25 are interposed between the support bracket 20 and the vehicle body 16. Specifically, the vibration insulators 25 are interposed between the respective mounting portions 22 of the support bracket 20 and the vehicle body 16. The vibration insulators 25 are made of, for example, rubber. In other words, the vibration insulators 25 are elastic bodies having elastic forces.

Configuration of Soundproofing Cover 40

The electric compressor 10 includes a soundproofing cover 40 covering an entire circumference of the outer peripheral surface 11*c* of the housing 11. The soundproofing cover 40 covers the housing 11 and the support bracket 20. The soundproofing cover 40 has a first cover 50 and a second cover 60. The first cover 50 and the second cover 60 each are made of a sound absorbing material that is elastically deformable and has sound absorbing properties. The first cover 50 and the second cover 60 are, for example, made of foamed resin urethane. In other words, the first cover 50 and the second cover 60 are made of flexible materials. Therefore, the soundproofing cover 40 is made of at least an elastically deformable sound absorbing material.

Configuration of First Cover 50

The first cover 50 includes a pair of first end walls 51 each having a plate shape, and a first peripheral wall 52 connecting the pair of first end walls 51 to each other. The first peripheral wall 52 includes a first cover body 53, a pair of first cover extensions 54, and a pair of first cover side portions 55.

The first cover body 53 and the pair of first cover extensions 54 are interposed between the support bracket 20 and the vehicle body 16. In other words, the first cover 50 is interposed between the support bracket 20 and the vehicle body 16. The first cover body 53 having a long plate shape extends in the axial direction of the housing 11 and curves along the outer peripheral surface 11*c* of the peripheral wall 11*b* of the housing 11. The first cover body 53 extends along the body 23 of the support bracket 20. A longitudinal direction of the first cover body 53 coincides with the axial direction of the housing 11. A longitudinal length of the first cover body 53 is longer than the longitudinal length of the body 23 of the support bracket 20. The first cover body 53 is in contact with the body 23 of the support bracket 20. The first cover body 53 covers a surface of the body 23 of the support bracket 20 on a side opposite to the housing 11.

The pair of first cover extensions 54 each having a flat plate shape extends outwardly from respective side edges of the first cover body 53 in a circumferential direction. The first cover extensions 54 extend along the respective extensions 24 of the support bracket 20. A longitudinal length of each of the pair of first cover extensions 54 is identical with a longitudinal length of the first cover body 53. The longitudinal length of each of the pair of first cover extensions 54 is longer than the longitudinal length of each of the pair of extensions 24 of the support bracket 20. The first cover extensions 54 are in contact with the associated extensions 24 of the support bracket 20. The first cover extensions 54 cover surfaces of the associated extensions 24 of the support bracket 20 on respective sides opposite to the housing 11.

The first cover side portions 55 each having a flat plate shape rise from respective end edges of the first cover extensions 54 on associated sides opposite to the first cover body 53. The first cover side portions 55 each extend along side edges of the associated extensions 24 of the support bracket 20 on associated sides opposite to the body 23. A longitudinal length of each of the pair of first cover side portions 55 is identical with the longitudinal length of each of the pair of first cover extensions 54. The longitudinal length of each of the pair of first cover side portions 55 is longer than the longitudinal length of each of the pair of extensions 24 of the support bracket 20. The first cover side portions 55 are in contact with the side edges of the associated extensions 24 of the support bracket 20 on the associated sides opposite to the body 23. The first cover side portions 55 cover the side edges of the associated extensions 24 of the support bracket 20 on the associated sides opposite to the body 23.

The pair of first cover side portions 55 each have two cutout portions 56. The cutout portions 56 of each of the first cover side portions 55 are cut out to allow the associated mounting portions 22 of the support bracket 20 to pass over. The mounting portions 22 of the support bracket 20 extend through the associated cutout portions 56.

The first cover extensions 54 each have two through holes 54*h*. Each of the through holes 54*h* extends through the associated first cover extension 54 in a thickness direction. The first cover 50 is disposed so that the through holes 54*h* communicate with the associated through holes 24*h* of the support bracket 20.

The first cover 50 is attached to the housing 11 together with the support bracket 20. Specifically, the first cover 50 is attached to the housing 11 together with the support bracket 20 by screwing bolts 57 into the associated female screw holes 15*a* of the mounting legs 15 through the associated through holes 54*h* of the first cover 50 and the associated through holes 24*h* of the support bracket 20. The first peripheral wall 52 of the first cover 50, which is disposed between the housing 11 and the vehicle body 16, covers a portion of the outer peripheral surface 11*c* of the housing 11 on a side close to the vehicle body 16 together with the bracket body 21 of the support bracket 20. The first end walls 51 of the first cover 50 cover portions of the associated end walls 11*a* of the housing 11 together with the bracket body 21 of the support bracket 20.

Configuration of Second Cover 60

The second cover 60 has a semi-cylindrical shape. The second cover 60 has a separate body from the first cover 50. The second cover 60 includes a pair of second end walls 61 each having a plate shape, and a second peripheral wall 62 having a semi-cylindrical shape and connecting the pair of second end walls 61 to each other. The second cover 60 is disposed with respect to the housing 11 so that the second peripheral wall 62 covers the remaining portion of the outer peripheral surface 11*c* of the peripheral wall 11*b* of the housing 11, which is uncovered by the first peripheral wall 52 of the first cover 50. In other words, the second peripheral wall 62 of the second cover 60 covers a portion of the outer peripheral surface 11*c* of the housing 11 on a side opposite to the vehicle body 16. The second peripheral wall 62 of the second cover 60 extends in a circumferential direction of the housing 11. The second peripheral wall 62 of the second cover 60 is in contact with the outer peripheral surface 11*c* of the housing 11. The second cover 60 is also disposed with respect to the housing 11 so that the second end walls 61 cover the remaining portions of the associated end walls 11*a* of the housing 11, which are uncovered by the first end walls 51 of the first cover 50.

Therefore, the entire housing 11 is covered by the first cover 50 and the second cover 60. In other words, the soundproofing cover 40 of the present embodiment has a combined structure of the first cover 50 having one of divided portions of a cylindrical shape into two and the second cover 60 having the other of the divided portions of the cylindrical shape into two.

The second cover 60 has insertion holes 60*h* through which the associated shank portions 17 are inserted. Each of the insertion holes 60*h* extends through the second peripheral wall 62. The second cover 60 is disposed with respect to the housing 11 so that the shank portions 17 of the housing 11 are inserted through the associated insertion holes 60*h* of the second cover 60. Fasteners 65 each having a disc shape, for example, are press-fitted onto ends of the respective shank portions 17 so that surrounding portions of the associated insertion holes 60*h* of the second peripheral wall 62 are pressed against the housing 11 by the fasteners 65 to be held between the fasteners 65 and the housing 11, by which the second cover 60 is attached to the housing 11.

First Sound Insulating Member 71 and Second Sound Insulating Member 72

The soundproofing cover 40 includes a first sound insulating member 71 and a second sound insulating member 72. The first sound insulating member 71 and the second sound insulating member 72 have greater hardness than those of the first cover 50 and the second cover 60. The first sound insulating member 71 and the second sound insulating member 72 are sound insulating sheets made of, for example, vinyl chloride resin, polyolefin resin, or the like.

The first sound insulating member 71 is disposed to cover a portion of an outer surface of the first cover 50. In other words, the first sound insulating member 71 covers the housing 11 and the support bracket 20 via the first cover 50. The first sound insulating member 71 is interposed between the first cover 50 and the vehicle body 16. The second sound insulating member 72 is disposed to cover a portion of an outer surface of the second cover 60. In other words, the second sound insulating member 72 covers the housing 11 via the second cover 60. The second sound insulating member 72 has a separate body from the first sound insulating member 71.

Relationship Between Electric Compressor 10 and Vehicle Body 16

The electric compressor 10 is mounted to the vehicle body 16 by screwing bolts 75 into respective female screw holes 16*a* of the vehicle body 16 through the associated insertion holes 22*h* of the mounting portions 22 of the support bracket 20 and through the associated vibration insulators 25. The support bracket 20 supports the housing 11 to the vehicle body 16. The vibration insulators 25 interposed between the support bracket 20 and the vehicle body 16 reduce a likelihood of transmission of a vibration generated from the housing 11 to the vehicle body 16 via the support bracket 20.

Operational Effect

The following will describe operational effects of the present embodiment.

The first cover 50 covers the portion of the outer peripheral surface 11*c* of the housing 11 on the side close to the vehicle body 16, and the second cover 60 covers the portion of the outer peripheral surface 11*c* of the housing 11 on the side opposite to the vehicle body 16. Therefore, even when a noise generated by driving the compression portion 12 or by driving the electric motor 13 causes the housing 11 to vibrate to generate a radiated sound, the radiated sound is absorbed by the first cover 50 and the second cover 60.

The first cover 50, which is disposed between the housing 11 and the vehicle body 16, covers the portion of the outer peripheral surface 11*c* of the housing 11 on the side close to the vehicle body 16 together with the support bracket 20. Therefore, even when a vibration from the housing 11 is transmitted to the support bracket 20 so that the support bracket 20 generates a radiated sound, the radiated sound is absorbed by the first cover 50.

Advantageous Effect

The following will describe advantageous effects of the present embodiment.

(1) The soundproofing cover 40 covers the housing 11 and the support bracket 20. Therefore, even when a radiated sound is generated from the housing 11 and the support bracket 20, the radiated sound is absorbed by the soundproofing cover 40. This reduces a noise from the electric compressor 10.

(2) The second cover 60 is attached to the housing 11. This configuration, for example, saves necessity to preassemble the first cover 50 and the second cover 60 so as to cover the outer peripheral surface 11*c* of the housing 11. This results in enhancement of workability.

(3) The first cover 50 is attached to the housing 11 together with the support bracket 20. Therefore, while the support bracket 20 is attached to the housing 11, the first cover 50 is concurrently attached to the housing 11. This configuration enhances the workability compared to a case where the support bracket 20 and the first cover 50 are individually attached to the housing 11.

(4) The first sound insulating member 71 is disposed to cover the outer surface of the first cover 50. In other words, the first sound insulating member 71 covers the housing 11 and the support bracket 20 via the first cover 50. Since the first cover 50 is interposed between the first sound insulating member 71 and the support bracket 20, the first sound insulating member 71 is unlikely to come into contact with the support bracket 20. Therefore, even when the first sound insulating member 71 is disposed to cover the support bracket 20, the first cover 50 reduces a likelihood of transmission of a vibration generated from the support bracket 20 to the first sound insulating member 71. This configuration reduces a noise generated from the electric compressor 10 even when the soundproofing cover 40 includes the first sound insulating member 71 having the hardness greater than that of the first cover 50.

Modifications

The embodiment according to the present disclosure may be modified as follows. The components of the above-described embodiment and the following modifications may be combined as far as they offer equivalent advantageous effects in essence to the technical scope of the claims.

Figure 4:
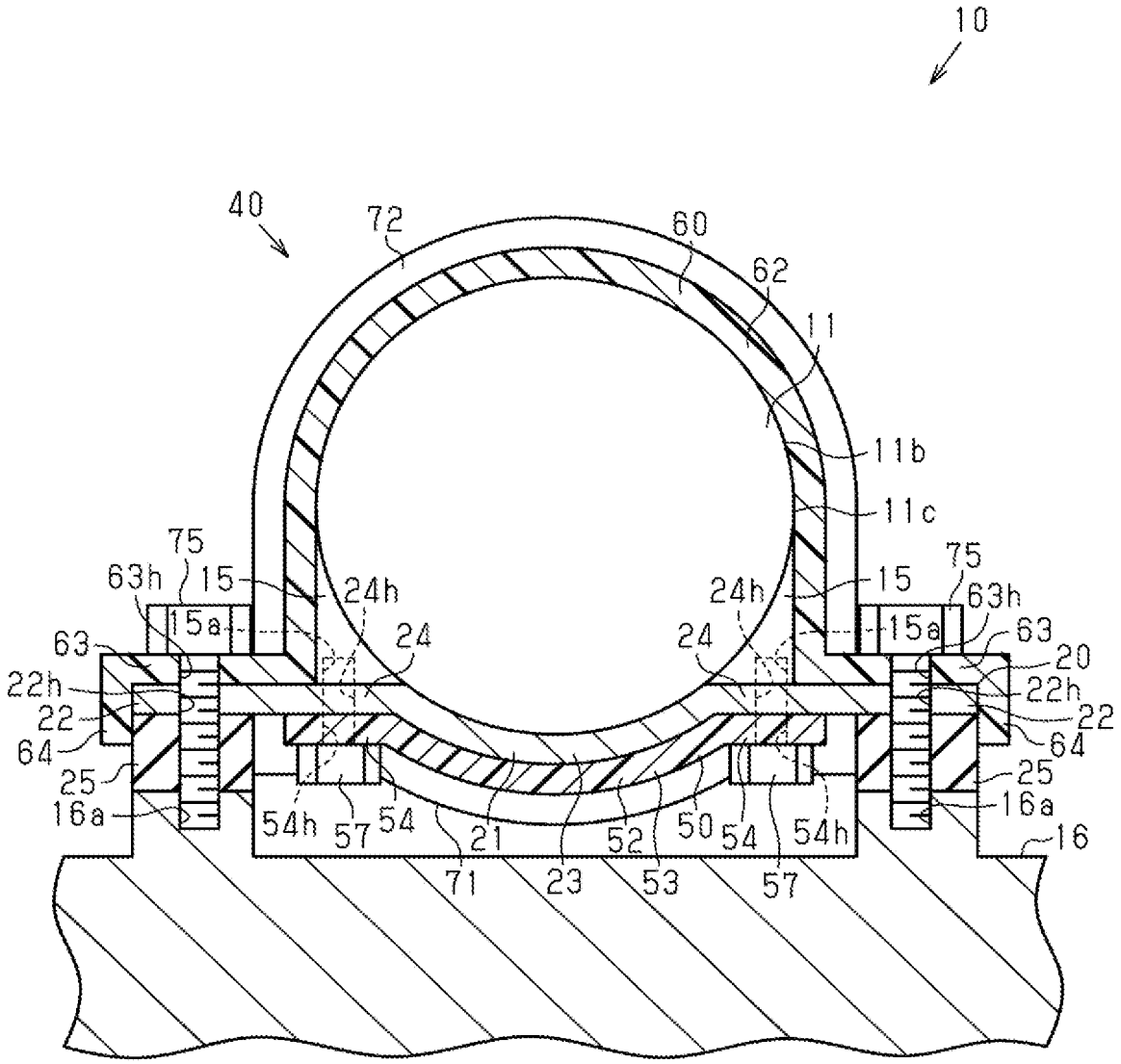
FIG. 4 is a schematic cross-sectional view of an electric compressor according to another embodiment of the present disclosure.

According to another embodiment as illustrated in FIG. 4, the second cover 60 may be attached to the support bracket 20. The second cover 60 according to this embodiment includes four flanges 63 each having a plate shape and extending outwardly from the second peripheral wall 62. The flanges 63 outwardly extend along surfaces of the associated mounting portions 22 of the support bracket 20 on sides opposite to the associated vibration insulators 25. The flanges 63 cover the surfaces of the associated mounting portions 22 on the sides opposite to the associated vibration insulators 25. The flanges 63 each have an insertion hole 63*h*. The flanges 63 are disposed with respect to the associated mounting portions 22 so that the insertion holes 63*h* communicate with the insertion holes 22*h* of the associated mounting portions 22.

The second cover 60 includes covering portions 64 that extend further from the associated flanges 63 along side edges of the associated mounting portions 22 on sides opposite to the associated extensions 24. The covering portions 64 cover the side edges of the associated mounting portions 22 on the sides opposite to the associated extensions 24. In this way, the second cover 60 may cover the mounting portions 22. Then, the bolts 75 are screwed into the respective female screw holes 16*a* of the vehicle body 16 through the associated insertion holes 63*h* of the flanges 63, the associated insertion holes 22*h* of the mounting portions 22, and the associated vibration insulators 25. In this way, the second cover 60 may be attached to the support bracket 20.

The configuration according to the above-described another embodiment saves necessity to attach the second cover 60 to the housing 11 and thus saves necessity for a design change of the housing 11 so as to attach the second cover 60 to the housing 11. This may simplify the configuration of the housing 11.

Since the second cover 60 covers the mounting portions 22, a radiated sound that can be generated from the mounting portions 22 is absorbed by the second cover 60. This further reduces a noise generated from the electric compressor 10.

In the embodiments, for example, portions of the first cover 50 may be interposed between the respective mounting portions 22 of the support bracket 20 and the associated vibration insulators 25 so as to cover the associated mounting portions 22. Alternatively, portions of the first cover 50 may cover portions of the respective mounting portions 22 and portions of the second cover 60 may cover the respective remaining portions of the mounting portions 22 uncovered by the first cover 50. In short, the soundproofing cover 40 only needs to cover the mounting portions 22.

In the embodiments, for example, the first cover body 53 and the body 23 of the support bracket 20 may be distanced from each other instead of being in contact with each other.

In the embodiments, for example, the first cover side portions 55 and the side edges of the associated extensions 24 of the support bracket 20 on the associated sides opposite to the body 23 may be distanced from each other, instead of being in contact with each other.

In the embodiments, for example, the second peripheral wall 62 of the second cover 60 and the outer peripheral surface 11*c* of the housing 11 may be distanced from each other, instead of being in contact with each other.

In the embodiments, the support bracket 20 does not need to be made of metal, but may be made of resin, for example. When the support bracket 20 is made of resin, the resin material is required to have a sufficient strength so that the support bracket 20 is capable of supporting the housing 11 to the vehicle body 16, for example.

In the embodiments, the vibration insulator 25 does not need to be made of rubber, but may be made of a meshed metal, for example. In short, as far as a material has a sufficient elastic force to reduce a likelihood of transmission of a vibration generated from the housing 11 to the vehicle body 16 via the support bracket 20, the vibration insulator 25 made of the material is acceptable.

In the embodiments, the first sound insulating member 71 may entirely cover the outer surface of the first cover 50.

In the embodiments, the second sound insulating member 72 may entirely cover the outer surface of the second cover 60.

In the embodiments, the soundproofing cover 40 may have the configuration that does not include the first sound insulating member 71 and the second sound insulating member 72. In short, the soundproofing cover 40 is acceptable as far as the soundproofing cover 40 is made of an elastically deformable sound absorbing material.

The configuration of the fastener 65 used for attaching the second cover 60 to the housing 11 is not limited to that of the above-described embodiments.

In the embodiments, a press-fitting pin may be used to attach the first cover 50 to the housing 11 together with the support bracket 20. In short, a type of a fastener used for attaching the first cover 50 to the housing 11 together with the support bracket 20 is not particularly limited to the type used in the above-described embodiment.

In the embodiments, the first cover 50 does not need to be attached to the housing 11 together with the support bracket 20, but the first cover 50 and the support bracket 20 may be individually attached to the housing 11, instead.

In the embodiments, for example, a press-fitting pin may be used to attach the electric compressor 10 to the vehicle body 16. In short, a type of a fastener used for attaching the electric compressor 10 to the vehicle body 16 is not particularly limited to the type used in the above-described embodiment.

In the embodiments, the number of the mounting legs 15 is not particularly limited to the number as described above.

In the embodiments, the compression portion 12 is not limited to the scroll type as described above, but may be provided by another type such as a piston type or a vane type.

In the embodiments, the electric compressor 10 is used for an air conditioning system for a vehicle. However, the electric compressor 10 may be mounted on a fuel cell vehicle and compress the air to be supplied to the fuel cell vehicle as the fluid.

In the embodiments, the object to which the electric compressor 10 is to be mounted may be an engine. In short, an object to which the electric compressor 10 is to be mounted is not particularly limited.

What is claimed is:

1. An electric compressor apparatus, comprising:

a compressor configured to compress a fluid;

an electric motor configured to drive the compressor;

an inverter configured to drive the electric motor;

a housing including an outer peripheral surface that has a cylindrical shape and accommodating the compressor, the electric motor, and the inverter;

a plurality of mounting legs disposed on the housing;

a support bracket fastened to the housing and supporting the housing to an object to which the electric compressor apparatus is mounted;

a vibration insulator interposed between the support bracket and the object; and a sound absorbing cover made of an elastically deformable sound absorbing material and covering the housing and the support bracket, wherein the sound absorbing cover includes:

a first cover interposed between the support bracket and the object; and a second cover provided separately from the first cover, wherein the second cover is attached to and in contact with the support bracket, and wherein the first cover is fastened to the plurality of mounting legs via bolts with the support bracket interposed between the first cover and the plurality of mounting legs.

2. The electric compressor apparatus according to claim 1, wherein the second cover is attached to the housing.

3. The electric compressor apparatus according to claim 2, wherein the first cover is attached to the housing together with the support bracket.

4. The electric compressor apparatus according to claim 1, wherein the support bracket includes a mounting portion mounted to the object, and the sound absorbing cover covers the mounting portion.

5. The electric compressor apparatus according to claim 1, wherein the first cover is attached to the housing together with the support bracket.

* * * * *